United States Patent [19]

Takahashi et al.

[11] 4,296,719

[45] Oct. 27, 1981

[54] MULTIPLE CYLINDER INTERNAL COMBUSTION ENGINE HAVING MIXTURE CUT OFF MEANS

[75] Inventors: Koichi Takahashi; Fumio Hinatase; Akira Shibanaka, all of Hiroshima, Japan

[73] Assignee: Toyo Kogyo Co., Ltd., Hiroshima, Japan

[21] Appl. No.: 77,278

[22] Filed: Sep. 20, 1979

[30] Foreign Application Priority Data

| | | | |
|---|---|---|---|
| Sep. 22, 1978 | [JP] | Japan | 53/117120 |
| Sep. 25, 1978 | [JP] | Japan | 53/118158 |
| Sep. 26, 1978 | [JP] | Japan | 53/118778 |

[51] Int. Cl.[3] ..... F02D 17/00

[52] U.S. Cl. ..... 123/198 F

[58] Field of Search ..... 123/198 F, 585, 586, 123/587; 261/23 A

[56] References Cited

U.S. PATENT DOCUMENTS

| | | | |
|---|---|---|---|
| 2,114,655 | 4/1938 | Leibing | 123/198 F |
| 2,947,298 | 8/1960 | Dolza | 123/198 F |
| 3,578,116 | 5/1971 | Nakajima | 123/198 F |
| 4,204,514 | 5/1980 | Ishida | 123/198 F |
| 4,207,856 | 6/1980 | Sugasawa | 123/198 F |

*Primary Examiner*—Ronald H. Lazarus

*Attorney, Agent, or Firm*—Fleit & Jacobson

[57] ABSTRACT

A multiple cylinder engine having an intake passage for each cylinder. A shut-off valve or valves are provided in the intake passage or passages leading to selected one or ones of cylinders downstream of the throttle valve. The shut-off valve is closed in idling operation so that the combustible mixture is totally supplied to the remainder of the cylinders to increase the mixture charge therein. The intake passage or passages leading to the selected cylinder or cylinders are supplied with air when the shut-off valves are closed so that the peak pressure in such cylinders is increased. The air supply is cut-off in deceleration in order for preventing the engine-brake effect from being weakened.

9 Claims, 4 Drawing Figures

MULTIPLE CYLINDER INTERNAL COMBUSTION ENGINE HAVING MIXTURE CUT OFF MEANS

The present invention relates to intake systems for internal combustion engines and more particularly to intake systems for multiple-cylinder engines. More specifically, the present invention pertains to intake systems for multiple-cylinder internal combustion engines in which means is provided for blocking mixture supply to selected one or ones of cylinders during idling operation.

Hithertofore, it has already been proposed in multiple-cylinder engines to provide shut-off valves in intake passages leading to selected ones of cylinders for closing the intake passages in idling operation and deceleration. Such arrangement is aimed to block supply of mixture to such selected cylinders and to thereby make it possible to increase mixture charge to the remainder of the cylinders. It is thus expected that this type of arrangement is effective to provide an improved combustion of mixture under the idling and deceleration and consequently improve fuel economy and pollutant emissions.

The proposed intake system is thus considered as being advantageous in providing an improvement in combustion in idling and deceleration and consequently contributing to an improvement in fuel economy and pollutant emissions, however, it has been found that the system has problems in that unacceptably strong vibrations are produced in idling operation due to torque fluctuations which are caused by the fact that combustion does not take place in cylinders associated with the shutter valves.

In the U.S. Pat. No. 2,114,655 issued to William E. Leibing on Apr. 19, 1938, there is disclosed an engine intake system having a shut-off valve for blocking mixture supply to selected ones of cylinders in an operation wherein the throttle valve is in minimum opening position. The intake system is also provided with an air control valve for opening an air passage which provides a supply of air to the selected cylinders when the shut-off valve is closed. The arrangement in the patent is considered as being effective in suppressing the engine vibrations under idling operations.

The U.S. Pat. No. 3,578,116 also discloses an engine intake system having shut-off valves in intake passages leading to selected ones of cylinders. The system is further provided with means for introducing air into the intake passages to the selected cylinders when the shut-off valves are closed. There is described that the air thus introduced is effective to insure the complete interruption of the mixture supply by suppressing leakage around the peripheries of the shut-off valves. There is further described that the air thus introduced is led to the exhaust pipes to be utilized for oxidizing unburnt constituents in the exhaust gas.

In the known arrangements described above, when a substantial amount of air is admitted to the intake passages associated with the shut-off valves to such an extent that the engine vibrations due to the output torque fluctuations can be suppressed, intake vacuum pressure is weakened in those intake passages. Thus situation would particularly be presented in the arrangement as disclosed in the U.S. Pat. No. 2,114,655. Further, those intake passages that are receiving the supply of the intake mixture have only weakened intake vacuum pressure due to the fact that the charge of intake mixture is increased. Consequently, there will be a significant loss of engine-brake effect in deceleration. Further, the function of intake vacuum operated means, such as a vacuum operated brake device, if any, will be undesirably disturbed.

In the U.S. Pat. No. 3,578,116, there is described that the air contamination problem can be solved without sacrificing the effectiveness of engine-braking action. This description is understood as stating that the amount of air supplied behind the shut-off valves is so limited that it does not disturb the engine-brake effect. It is therefore construed in the patent that the amount of air thus introduced is not substantial and therefore inadequate to suppress the engine vibrations. In fact, the patent teaches to suppress the engine vibrations by properly determining the firing sequence among the cylinders.

It is therefore an object of the present invention to provide an intake system for multiple cylinder engines having means for blocking supply of intake mixture to selected ones of cylinders in idling operation as well as means for suppressing engine vibrations due to output torque fluctuations without weakening the engine-brake effect.

Another object of the present invention is to provide an intake system for multiple-cylinder engines of the aforementioned type which can ensure effectiveness of any equipment such as a brake device which is actuated under the intake vacuum pressure.

A further object of the present invention is to provide an intake system for multiple cylinder engines, which is provided with means for blocking supply of intake mixture to selected ones of cylinders in idling operation and in which smooth acceleration from the idling speed can be ensured.

Still further object of the present invention is to provide an engine intake system which can ensure reliable operation of the exhaust gas purifying system.

Still further object of the present invention is to provide an intake system for multiple cylinder engines, which includes shut-off valve means for blocking supply of intake mixture into selected ones of cylinders in idling operation and in which means is provided for controlling opening of the shut-off valve means in acceleration so that the acceleration is matched to the opening of the engine throttle valve means.

Yet further object of the present invention is to provide a dual induction type engine intake system comprising a primary and secondary intake passages for each cylinder and provided with shut-off valve means which serves to block the supply of intake mixture to selected ones of cylinders in idling operation, as well as means for preventing delay of response in fuel supply means when the shut-off valve means is opened for acceleration so that a satisfactory accelerating performance can be ensured.

According to the present invention, in order to accomplish the above and other objects, there is provided an internal combustion engine including a plurality of cylinders, intake passage means including first passage means leading to at least one of said cylinders and second passage means leading to the remainder of said cylinders, throttle valve means provided in said intake passage means and having a minimum opening position, means for providing a supply of combustible air and fuel mixture to said first and second passage means, shut-off valve means provided in said first passage means downstream of said mixture supply means and movable to a closed position for blocking the supply of the mixture to the cylinder associated with said first passage means, means for detecting that the throttle valve means is in the minimum opening position and moving the shut-off valve means to said closed position when the throttle valve means is in the minimum opening position, means for providing a supply of air to said cylinder associated with said first passage means, control means sensible to engine speed and throttle valve position and controlling said air supply means so that a substantial amount of air is supplied to said cylinder when the throttle valve means is in the minimum opening position and the engine speed is below a predetermined value but the air supply is essentially interrupted when the engine speed is beyond the predetermined value.

According to the present invention, the substantial amount air is supplied to the cylinder associated with the first passage means when the shut-off valve is closed, so that it is possible to suppress or decrease the engine vibration due to the fluctuations in the output torque. Further, since the air supply is interrupted in deceleration wherein the throttle valve means is in the minimum opening position but the engine speed is still high, it is possible to ensure an effective engine-brake effort. It is also possible to maintain the function of brake devices which are actuated by an intake vacuum pressure in deceleration. Preferably, the amount of air supplied to the engine is such that the peak pressure in the cylinder is not less than 60% of the peak pressure in the remainder of the cylinders.

If the supply of air is started substantially at the same time as the engine attains the idling speed, since there may possibly be an abrupt increase in the peak pressure, there may be a danger of an undesirable engine stop. To avoid the problem, if the supply of air is started when the engine speed is still high, such air supply will be continued in acceleration until the engine speed is increased to a certain value. Thus, air will be introduced into the cylinder together with the air and fuel mixture during the acceleration causing an excessively lean mixture and possibly resulting in misfire. According to a further aspect of the present invention, the above problem is therefore solved by an arrangement in which said predetermined value of the engine speed is a value higher than the idling speed and said control means is provided with means for interrupting the air supply under acceleration even when the engine speed is below the predetermined value. More specifically, the control means may be such that it controls the air supply means so that the air supply is interrupted as soon as the throttle valve means is moved from the minimum opening position for acceleration.

According to a further aspect of the present invention, the engine includes an exhaust system provided with exhaust gas purifying system having means for supplying air to the exhaust system for effecting oxidation of unburnt constituents in the exhaust gas, means being provided for at least decreasing the air supply to the exhaust system when the air is supplied to the cylinder associated with the first passage means. The arrangement will be effective to prevent supply of excessive amount of air to the exhaust gas purifying means. Thus, it is possible to ensure appropriate functions of the exhaust gas purifying system.

According to another aspect of the present invention, means is provided for delaying opening movement of the shut-off valve means under a relatively slow acceleration in which the throttle valve means is relatively slowly opened. When the present invention is applied to an engine having a dual induction type intake system which includes a primary and secondary intake passages for each cylinder, it is preferable to supply the air only to the secondary intake passage which is adapted to be used only under a heavy load operation. If the air supply is made both to the primary and secondary intake passages, fuel deposit on the wall of the primary intake passage will be vaporized by the air stream so that there will be a delay of fuel supply to the associated cylinder in the succeeding acceleration step. The above arrangement is considered as being effective in preventing such vaporization of fuel deposited on the wall of the primary intake passage, so that a smooth acceleration can be ensured.

The above and other objects and features of the present invention will become apparent from the following descriptions of preferred embodiments taking reference to the accompanying drawings, in which.

Figure 1:
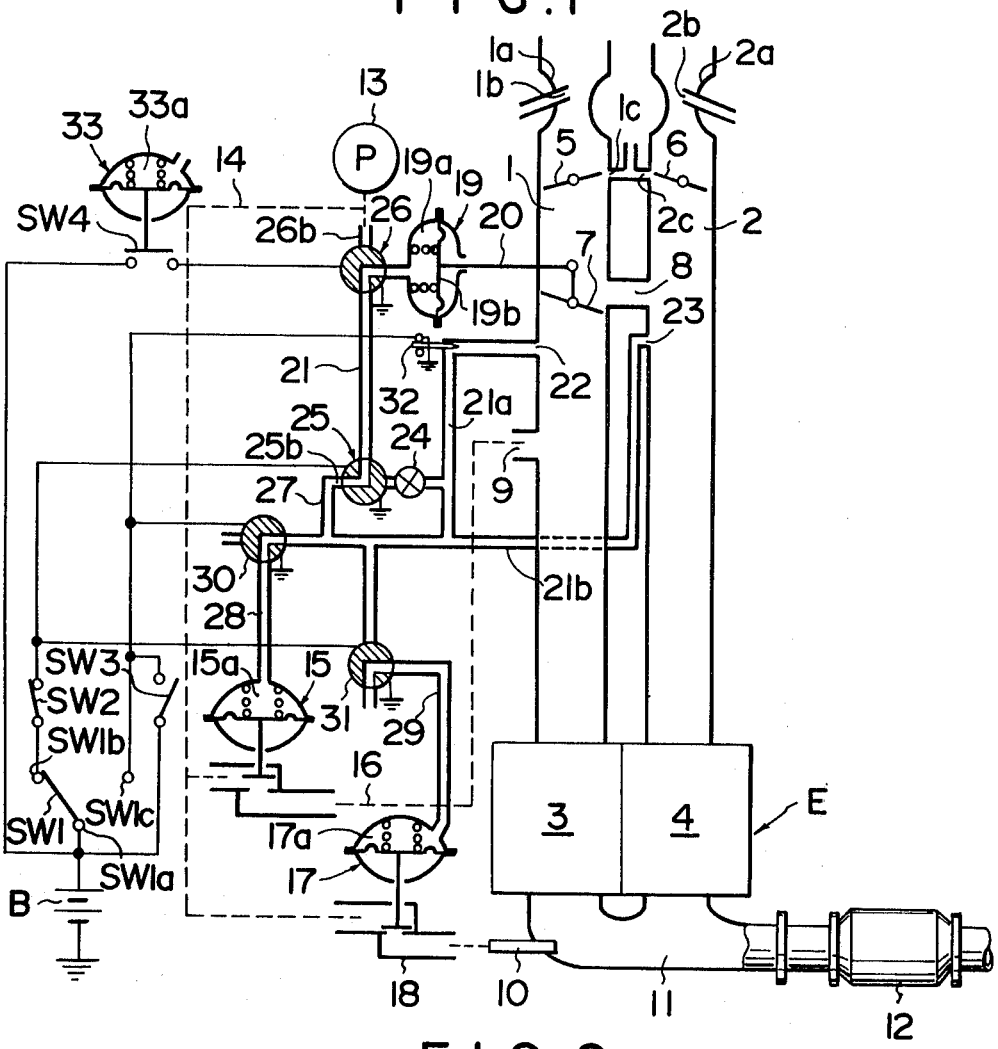
FIG. 1 is a schematic illustration of an internal combustion engine having an intake system embodying the features of the present invention.

Referring now to the drawings, particularly to FIG. 1, the engine shown therein includes a first and second intake passages 1 and 2 respectively leading to a first and second cylinders 3 and 4 which are shown only diagrammatically. The intake passages 1 and 2 are respectively provided with venturi portions 1*a* and 2*a* having main fuel nozzles 1*b* and 2*b*, respectively. In the intake passages 1 and 2, there are respectively provided throttle valves 5 and 6 downstream of the venturi portions 1*a* and 1*b*. Slow fuel ports 1*c* and 2*c* open respectively to the passages 1 and 2 in the vicinity of the throttle valves 5 and 6.

In the first intake passage 1, there is a shutoff valve 7 which is located downstream of the throttle valve 5. The first intake passage 1 is connected at a portion between the valves 5 and 7 with the second intake passage 2 by means of a communication passage 8. The cylinders 3 and 4 are connected with an exhaust pipe 11 which is provided with an exhaust gas purifying device 12 of a suitable type, such as a catalyst type. In order to supply the device 12 with air, the exhaust pipe 11 is provided with an air injection nozzle 10 which receives a supply of air from an air pump 13 through a conduit 14 and an air passage 18. For controlling the air supply to the exhaust gas purifying device 12, the air passage 18 has a intake vacuum controlled valve 17.

The intake system shown in FIG. 1 includes a device for controlling the shut-off valve in accordance with the engine operating conditions. Such device includes a vacuum actuator 19 which has a vacuum chamber 19*a* defined by a diaphragm 19*b* and a link 20 connecting the diaphragm 19*b* with the shut-off valve 7. Thus, the shut-off valve 7 is normally maintained in open position but closed by the actuator 19 when the vacuum chamber 19*a* is subjected to a vacuum pressure.

The vacuum chamber 19*a* of the actuator 19 is connected with a solenoid valve 26 which is connected on one hand with a conduit 21 and on the other hand with a conduit 26b leading from the outlet of the air pump 13. The solenoid valve 26 functions to connect the vacuum chamber 19a in energized condition with the conduit 26b and in de-energized condition with the conduit 21.

The first intake passage 1 is formed downstream of the shut-off valve 7 with a first vacuum port 22 which is connected through a conduit 21a having a vacuum control valve 24 and through a solenoid valve 25 with the conduit 21. The second intake passage 2 is formed downstream of the communication passage 8 with a second vacuum port 23 communicating with a conduit 21b which is on one hand connected with the conduit 21a and on the other hand through a conduit 27 with the solenoid valve 25. The solenoid valve 25 functions to connect the conduit 21 with the conduit 27 when energized and with the valve 24 when de-energized.

The primary intake passage 1 is further formed with an air supply port 9 which is connected through an air passage 16 with the air passage 14 from the air pump 13. The air passage 16 is provided with a vacuum operated valve 15 which has a vacuum chamber 15a connected through a conduit 28 and a solenoid valve 30 with the conduit 21b. The solenoid valve 30 functions to connect the conduit 28 with the atmosphere when energized and with the conduit 21b when de-energized. The valve 15 is normally maintained in closed position but moved to open position when the chamber 15a is subjected to vacuum.

The vacuum operated valve 17 provided in the air passage 18 has a vacuum chamber 17a which is connected through a conduit 29 with a solenoid valve 31. The valve 31 functions to connect the conduit 29 to the atmosphere when energized but to the conduit 21b when de-energized. The valve 17 is normally maintained in closed position but moved to open position when the chamber 17a is subjected to vacuum pressure. The conduit 21a is provided with a solenoid valve 32 which functions to open the conduit when energized and close when deenergized.

The solenoid valves are operated by electric circuits which include a power source such as a battery B connected with a throttle valve switch SW1 having a common contact SW1*a* connected with the battery B and switching contacts SW1*b* and SW1*c*. The contact SW1*b* is connected through a first engine speed switch SW2 with the solenoid valves 25 and 31. The contact SW1*c* is connected with the solenoid valves 30 and 32. Further, the valves 30 and 32 are also connected through a second engine speed switch SW3 with the battery B. The switch SW2 is closed when the engine speed is below a predetermined value, such as 1100 rpm but the switch SW3 is closed when the engine speed is above the predetermined value. The throttle valve switch SW1 is connected with the throttle valve 5 so that the contact SW1*b* is closed when the throttle valve 5 is in the minimum opening position but the contact SW1*c* is closed when the throttle valve 5 is opened from the minimum opening position.

The solenoid valve 26 is connected through a vacuum operated switch SW4 with the battery B. The switch SW4 has a vacuum actuator 33 which has a vacuum chamber 33a connected with the port 23. The switch 24 is normally maintained in opened position by a vacuum pressure applied to the chamber 33a, but closed when the throttle valves 5 and 6 are widely opened and the vacuum pressure is decreased.

Figure 2:
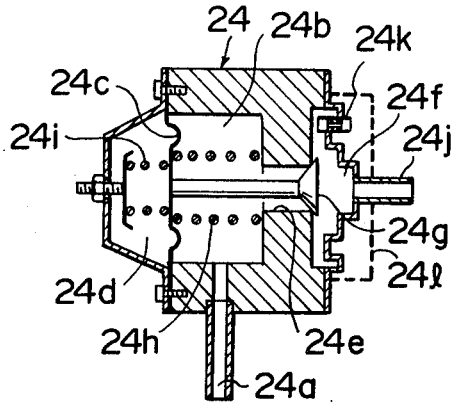
FIG. 2 is an enlarged sectional view of a control valve used in the intake system shown in FIG. 1.

Referring now to FIG. 2, there is shown the details of the vacuum control valve 24. The valve 24 has a diaphragm 24c which defines a vacuum chamber 24b and an atmospheric pressure chamber 24d, the former chamber 24b being provided with a vacuum inlet 24a. The diaphragm 24c carries a valve member 24g which cooperates with a valve port 24e connecting the vacuum chamber 24b with a control chamber 24f which has an outlet port 24j. Balance springs 24h and 24i are provided respectively in the chambers 24b and 24d so as to act on the diaphragm 24c. The control chamber 24f is provided with a relief port 24k so that air is admitted from an air filter 24l through the port 24k to the control chamber 24f. Thus, when the vacuum pressure in the chamber 24b is increased beyond a predetermined value which is determined by the forces of the springs 24h and 24i, the diaphragm 24c is shifted rightwards to open the port 24e so that the vacuum pressure is introduced into the chamber 24f. The vacuum inlet 24a is connected with the conduit 21a and the outlet 24j with the valve 25.

The operation of the arrangements will now be described.

Idling Operation

In idling operation, the throttle valves 5 and 6 are in the minimum opening positions so that strong vacuum is produced in the intake passages 1 and 2 downstream of the throttle valves 5 and 6. Thus, the switch SW4 is opened. Since the engine speed is lower than the aforementioned predetermined value, for example, 1,100 rpm, the switch SW2 is closed and the switch SW3 is opened. Further, the contact SW1*b* of the switch SW1 is closed.

As the result, the solenoid valves 25 and 31 are energized and the solenoid valves 26, 30 and 32 are de-energized. The vacuum conduit 21a from the port 22 is therefore closed by the solenoid valve 32. However, the intake vacuum pressure in the second intake passage 2 is transmitted through the conduits 21b and 27 and the valve 25 to the conduit 21 and then through the valve 26 to the vacuum chamber 19a of the actuator 19. Thus, the shut-off valve 7 is closed by the actuator 19 through the link 20. It should therefore be noted that the intake mixture through the throttle valves 5 and 6 is totally introduced through the passage 2 to the cylinder 4 resulting in an increase in the mixture charge to the cylinder 4.

At the same time, the vacuum pressure in the conduit 21b is transmitted through the valve 30 and the conduit 28 to the vacuum chamber 15a in the valve 15. Thus, the air passage 16 is opened and the air from the pump 13 is admitted through the air port 9 to the first intake passage 1 downstream of the shut-off valve 7. The air thus introduced into the first intake passage 1 is totally introduced into the cylinder 3 to thereby increase the peak pressure in the cylinder 3. It is therefore possible to decrease engine vibration due to fluctuations in the output torque.

The vacuum chamber 17a of the valve 17 is at this instance opened to atmosphere so that the valve 17 is closed. The air supply through the air nozzle 10 is therefore interrupted. In this position, the air which has passed through the cylinder 3 is supplied to the exhaust gas purifying device 12. Therefore, it is possible to maintain a supply of air to the device 12 which is required for oxidation of unburnt constituents in the exhaust gas. The arrangement may be such that the valve 17 is maintained in part-open position so that the air discharge through the nozzle 10 is not completely cut-off but the amount of air discharge is only decreased.

Figure 3:
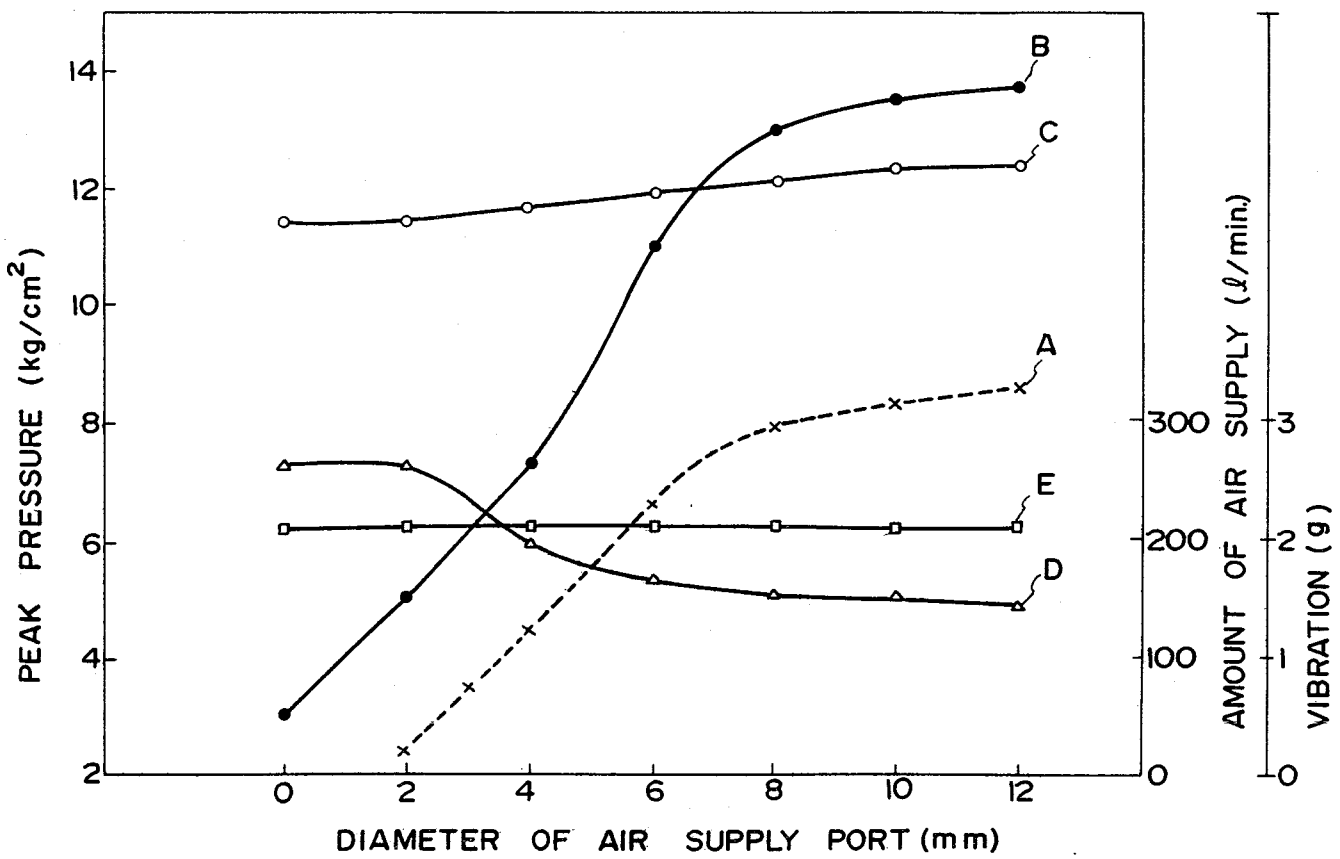
FIG. 3 is a diagram showing the advantageous effects of the air supply; and, FIG. 4 is a schematic illustration of an internal combustion engine in accordance with another embodiment of the present invention.

Referring to FIG. 3, it will be noted that the amount of air supply through the air port 9 is increased as shown by the curve A as the diameter of the port 9 is increased. The peak pressure due to the compression of the air in the cylinder 3 then increases as shown by the curve B and finally exceeds the peak pressure due to the combustion of the mixture in the cylinder 4 which is shown by the curve C.

The engine vibration may be measured in terms of vibrations of a shift lever (not shown) of an automobile equipped with the engine. The vibration of the shift lever changes as shown by the curve D. It will be noted that the vibration decreases in response to an increase in the peak pressure in the cylinder 3. Where the peak pressure B in the cylinder 3 is greater than the peak pressure C in the cylinder 4, the vibrations are as small as those in engines which do not have shut-off valves. It is possible to decrease the vibrations by approximately 50% of the vibration increase due to the existence of shut-off valve by introducing air into the cylinder 3 so that the peak pressure in the cylinder 3 is greater than 60% of the peak pressure in the cylinder 4.

Thus, from the viewpoint of suppressing engine vibrations, it is advisable to increase the amount of air into the cylinder 3. However, such increase in the amount of air supply has an undesirable effect on the function of the catalyst type exhaust gas purifying device. More specifically, the air supplied to the cylinder 3 is totally passed to the exhaust system and may cause a temperature decrease in the exhaust gas purifying device. Therefore, the amount of air supply must be limited from this point of view.

Slow Acceleration from Idling

When the throttle valves 5 and 6 are relatively slowly opened from the minimum opening positions for effecting slow acceleration, the throttle valve switch SW1 is actuated so that the contact **SW1*b* is opened and the contact SW1*c* is closed. Thus, the solenoid valves 25 and 31 are de-energized and the solenoid valves 30 and 32 are energized. As the result, the vacuum pressure behind the shut-off valve 7 is applied through the conduit 21*a* to the vacuum control valve 24. Further, the vacuum chamber 15*a* in the valve 15 is opened through the solenoid valve 30 to atmosphere so that the valve 15 is closed and the air supply to the first intake passage 1 is thus interrupted. The solenoid valve 25 is moved to a position where the conduit 21 is connected with the outlet port 24*j* of the vacuum control valve 24**.

Since a strong vacuum is produced in the first intake passage 1 downstream of the shut-off valve 7 due to the interruption of the air supply, the valve 24 is opened and the vacuum pressure is applied through the conduit 21 to the actuator 19. Thus, the shut-off valve 7 is maintained in the closed position even after the throttle valves 5 and 6 are opened. Since the conduit **21*a* is connected with the conduit 21*b* leading from the port 23 at the second intake port 2, the vacuum pressure from the port 22 is weakened by the vacuum pressure from the port 23 before it is applied to the valve 24**.

In this manner, during the initial stage of the slow acceleration, only the cylinder 4 is in operation and the engine output increase is produced only through the output increase in the cylinder 4. As the throttle vlaves 5 and 6 are opened to such an extent that the vacuum pressure applied to the valve 24 becomes so weak that the valve 24 is closed, the actuator 19 is released of the vacuum pressure so that the shut-off valve 7 is opened. Then, the mixture is supplied to the cylinder 3 so that the output is produced even in the cylinder 3.

Rapid Acceleration from Idling

When the throttle valves 5 and 6 are rapidly opened, the vacuum pressure at the port 23 is weakened so that the switch actuator 33 moves the switch SW4 to the closed position. The solenoid valve 26 is thus energized and moved to a position where it opens the vacuum chamber **19*a* of the actuator 19 to the outlet of the air pump 13. Thus, the shut-off valve 7 is immediately opened to bring the cylinder 3** into operation.

At this moment, since the solenoid valve 30 is energized through the throttle valve switch SW1, the valve 15 is closed to interrupt the air supply to the first intake passage 1.

Deceleration from the Engine Speed above 1100 rpm

When the throttle valves 5 and 6 are moved to the minimum opening positions under the engine speed above 1100 rpm, the contact **SW1*b* of the throttle valve switch SW1 is closed but the engine speed switch SW2 is opened. The solenoid valves 25 and 31 are therefore deenergized. Since the engine speed switch SW3 is closed, the solenoid valves 30 and 32 are energized. Further, the switch Sw4 is opened under the vacuum pressure prevailing in the second intake passage 2**.

The vacuum pressure from the port 22 is applied to the valve 24 and, where the vacuum is strong enough to open the valve 24, the vacuum is applied through the conduit 21 to the vacuum chamber of the actuator 19. The shut-off valve 7 is therefore closed. It should however be noted that in this instance the solenoid valve 30 is energized and the valve 15 is therefore closed. Thus, the air supply to the first intake passage 1 is interrupted and it is therefore possible to provide an adequate engine-brake effect. Under the deceleration, the engine vibrations due to the torque fluctuations are not serious.

Decleration from the Engine Speed below 1100 rpm

When the throttle valves 5 and 6 are closed with the engine speed less than 1100 rpm, the contact **SW1*b* of the throttle valve switch SW1 is closed, while the engine speed switch SW2 is closed and the engine speed switch SW3 is opened. The vacuum switch SW4 is opened under the vacuum pressure in the second intake passage 2**. Thus, the positions of the solenoid valves are the same as in the idling operation. The operations are therefore the same as in the idling operation.

In this embodiment, the air supply to the first intake passage 1 is started when the engine speed is still higher than the idling speed. However, this does not cause any problem since the engine-brake effect is not strongly expected in the operating range slightly above the idling speed. Further, although the air supply to the first intake passage 1 is made by the air pump 13, the air supply passage 16 may be opened to atmosphere. It should further be noted that in the illustrated embodiment separate carburetors are provided respectively for the intake passages 1 and 2, however, a single common carburetor may be provided for the intake passages.

Figure 4:
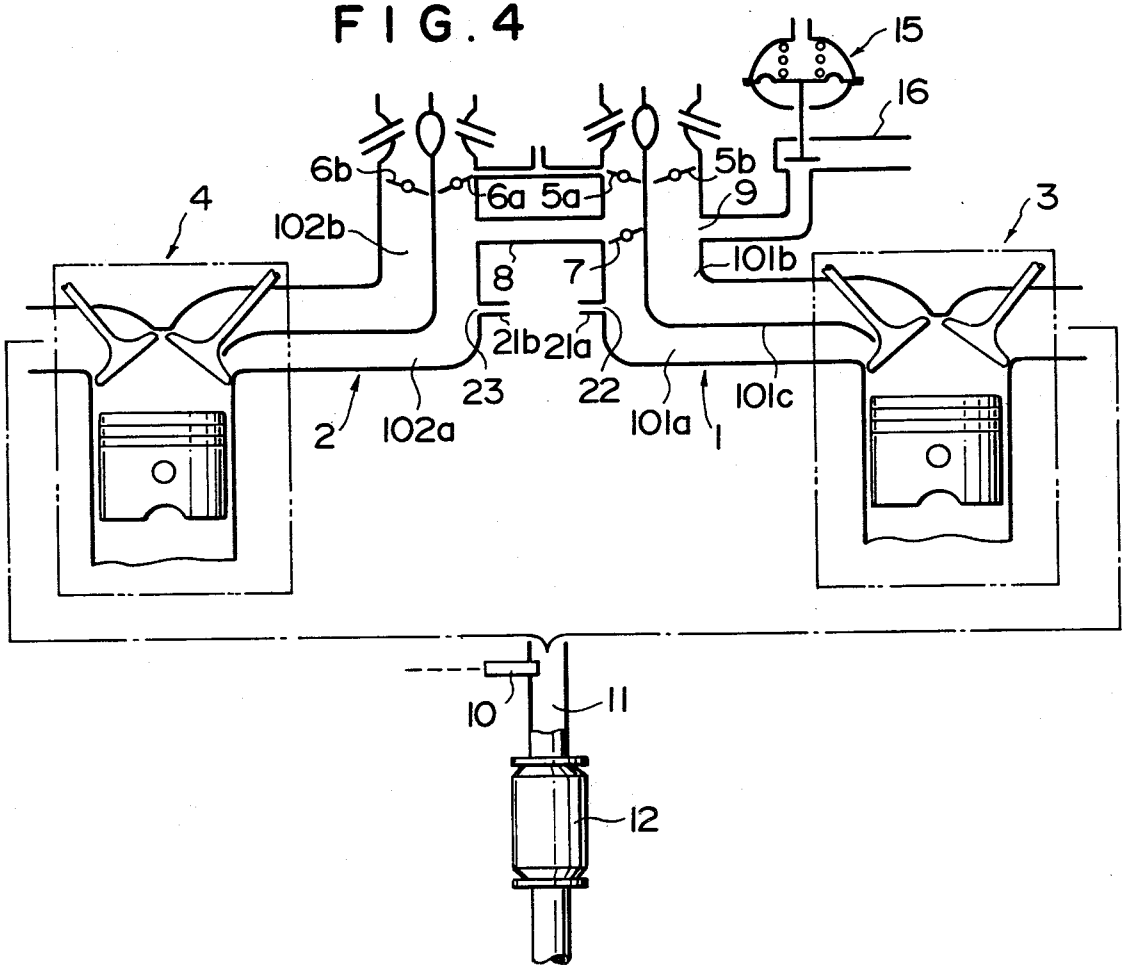

Referring now to FIG. 4, there is shown an embodiment wherein the present invention is applied to an engine having a dual induction type intake system. More specifically, the engine includes a first and second cylinders 3 and 4 which are provided with a first and second intake passages 1 and 2, respectively. The first intake passage 1 includes a primary passage 101*a* and a secondary passage 101*b* which are separated by a partition wall 101*c* extending to the intake port of the cylinder 3. The primary and secondary passages 101*a* and 101*b* are respectively provided with a primary and secondary throttle valves 5*a* and 5*b*. In light and medium load operations, the secondary throttle valve 5*b* is essentially closed so that the intake mixture is substantially passed through the primary passage 101*a* into the cylinder 3. Under a heavy load operation, the secondary throttle valve 5*b* is opened to provide an additional supply of air and fuel mixture. The dual induction system is known as being advantageous in that a high flow speed of mixture can be maintained even in light and medium load operations. Similarly, the second intake passage 2 comprises a primary and secondary passages 102*a* and 102*b* respectively provided with a primary and secondary throttle valves 6*a* and 6*b*.

In the illustrated embodiment, the primary passage 101*a* of the first intake passage 1 is provided with a shut-off valve 7 located downstream of the throttle valve 5*a*. The primary passage 101*a* is connected at a portion upstream of the shut-off valve 7 with the primary passage 102*a* by a communication passage 8. Further, vacuum take-out ports 22 and 23 are respectively provided in the passages 101*a* and 102*a* and connected with the conduits 21*a* and 21*b*, respectively.

In the secondary passage 101*b* of the first intake passage 1, there is provided an air supply port 9 connected with an air supply passage 16 which has a vacuum operated valve 15. In other respects, the arrangements are the same as in FIG. 1 so that they are omitted in FIG. 4. The arrangement is advantageous in that the air supply to the cylinder 3 is made, when the shut-off valve 7 is closed, only to the secondary passage 101*b* so that fuel deposit on the wall surface of the primary passage 101*a* is not vaporized by the air flow during the idling operation. It is therefore possible to prevent any delay of fuel supply in acceleration from the idling operation.

The invention has thus been shown and described with reference to specific embodiments, however, it should be noted that the invention is in no way limited to the details of the illustrated arrangements but changes and modifications may be made without departing from the scope of the appended claims.

We claim:

1. Internal combustion engine comprising a plurality of cylinders, intake passage means including first passage means leading to at least one of said cylinders and second passage means leading to the remainder of said cylinders, throttle valve means provided in said intake passage means and having a minimum opening position, means for providing a supply of combustible air and fuel mixture to said first and second passage means, shut-off valve means provided in said first passage means downstream of said mixture supply means and movable to a closed position for blocking the supply of the mixture to the cylinder associated with said first passage means, means for detecting that the throttle valve means is in the minimum opening position and moving the shut-off valve means to said closed position when the throttle valve means is in the minimum opening position, means for providing a supply of air to said cylinder associated with said first passage means, control means sensible to engine speed and throttle valve position and controlling said air supply means so that a substantial amount of air is supplied to said cylinder associated with said first passage means when the throttle valve means is in the minimum opening position and the engine speed is below a predetermined value but the air supply is essentially interrupted when the engine speed is beyond the predetermined value.

2. Engine in accordance with claim 1 in which the air supply means supplies air to the cylinder associated with said first passage means by such an amount that the peak pressure in the specific cylinder is not less than 60% of the peak pressure in the remainder of the cylinders.

3. Engine in accordance with claim 1 which further includes delay means for delaying opening movement of the shut-off valve means when the throttle valve means is slowly opened from the minimum opening position for slow acceleration.

4. Engine in accordance with claim 3 in which said delay means includes responsive to vacuum pressure in said first passage means downstream of the shut-off valve means and vacuum pressure in said second passage means downstream of the throttle valve means so that the shut-off valve means is opened when the vacuum pressure in the second passage means is weakened beyond a predetermined value.

5. Engine in accordance with claim 1 which further includes exhaust gas purifying means provided in exhaust system, secondary air supplying means for supplying air to said exhaust gas purifying means associated with said exhaust system and means for at least decreasing the secondary air supply by the secondary air supplying means when the air supply means supplies air to the cylinder associated with said first passage means.

6. Engine in accordance with claim 1 in which said predetermined value of the engine speed is a value higher than the idling speed and said control means is provided with means for interrupting the air supply under acceleration even when the engine speed is below the predetermined value.

7. Engine in accordance with claim 1 in which said predetermined value of the engine speed is a value higher than the idling speed and said control means is provided with means for interrupting the air supply under acceleration as soon as the throttle valve means is moved from the minimum opening position.

8. Internal combustion engine comprising a plurality of cylinders, first intake passage means leading to at least one of said cylinders, second intake passage means leading to the remainder of the cylinders, said first intake passage means including for each cylinder associated therewith a first primary passage and a first secondary passage which are separated from each other, said second intake passage means including for each cylinder associated therewith a second primary passage and a second secondary passage which are separated from each other, primary throttle valves respectively provided in said first and second primary passages and having minimum opening positions, secondary throttle valves respectively provided in said first and second secondary passages so that the secondary throttle valves are opened only for heavy load operation of the engine, means for supplying combustible mixture to said passages, shut-off valve means provided in said first primary passage downstream of said mixture supply means and movable to a closed position for blocking the supply of the mixture to the cylinder associated with said first intake passage means, means for detecting that the primary throttle valve is in the minimum opening position and moving the shut-off valve means to said closed position when the primary throttle valve is in the minimum opening position, means for providing a supply of air to said first secondary passage, control means sensible to engine speed and throttle valve position and controlling said air supply means so that a substantial amount of air is supplied to said first secondary passage when the throttle valve means is in the minimum opening position and the engine speed is below a predetermined value but the air supply is essentially interrupted when the engine speed is beyond the predetermined value.

9. Engine in accordance with claim 2 in which said first passage means includes for each cylinder associated therewith a first primary passage and a first secondary passage which are separated from each other, said second passage means including for each cylinder associated therewith a second primary passage and a second secondary passage which are separated from each other, said throttle valve means including primary throttle valves respectively provided in said first and second primary passages and having minimum opening positions, secondary throttle valves respectively provided in said first and second secondary passages so that the secondary throttle valves are opened only for heavy load operation of the engine, said shut-off valve means being provided in said first primary passage downstream of said mixture supply means and movable to a closed position for blocking the supply of the mixture to the cylinder associated with said first intake passage means, said air supplying means being arranged so that it provides a supply of air to said first secondary passage.

* * * * *